US009423088B2

(12) United States Patent
Park et al.

(10) Patent No.: US 9,423,088 B2
(45) Date of Patent: Aug. 23, 2016

(54) HEAD LAMP APPARATUS FOR VEHICLES

(71) Applicants: Hyundai Motor Company, Seoul (KR); Hyundai Mobis Co., Ltd., Seoul (KR)

(72) Inventors: Sung Ho Park, Whasung-Si (KR); Hyun Soo Lee, Whasung-Si (KR)

(73) Assignees: Hyundai Motor Company, Seoul (KR); Hyundai Motor Co., Ltd., Seoul (KR)

( * ) Notice: Subject to any disclaimer, the term of this patent is extended or adjusted under 35 U.S.C. 154(b) by 73 days.

(21) Appl. No.: 14/468,057

(22) Filed: Aug. 25, 2014

(65) Prior Publication Data

US 2015/0176793 A1 Jun. 25, 2015

(30) Foreign Application Priority Data

Dec. 23, 2013 (KR) ..... 10-2013-0161139

(51) Int. Cl.

| | |
|---|---|
| ***F21V 9/00*** | (2015.01) |
| ***F21S 8/10*** | (2006.01) |
| *F21Y 101/02* | (2006.01) |

(52) U.S. Cl.

CPC ..... *F21S 48/1241* (2013.01); *F21S 48/1154* (2013.01); *F21S 48/1159* (2013.01); *F21S 48/1258* (2013.01); *F21S 48/137* (2013.01); *F21S 48/1323* (2013.01); *F21S 48/1388* (2013.01); *F21S 48/142* (2013.01); *F21S 48/145* (2013.01); *F21S 48/328* (2013.01); *F21Y 2101/02* (2013.01)

(58) Field of Classification Search

CPC ..... F21S 48/1216; F21S 48/1241; F21S 48/2225; F21S 48/2287; F21S 48/1323; F21S 48/1154; F21S 48/1159; F21S 48/125; F21S 48/328; F21S 48/137; F21S 48/1388; F21S 48/142; F21S 48/145; F21S 48/1258; F21S 8/10

USPC ..... 362/511

See application file for complete search history.

(56) References Cited

U.S. PATENT DOCUMENTS

| | | | | |
|---|---|---|---|---|
| 2008/0080207 | A1* | 4/2008 | Specht | F21S 48/1241 362/581 |
| 2013/0194816 | A1* | 8/2013 | Hager | F21S 48/115 362/511 |
| 2014/0016343 | A1* | 1/2014 | Brendle | F21S 48/1159 362/518 |

FOREIGN PATENT DOCUMENTS

| | | | |
|---|---|---|---|
| JP | 7-261028 | A | 10/1995 |
| JP | 2009-146722 | A | 7/2009 |
| JP | 2010-147025 | A | 7/2010 |
| KR | 10-2009-0051009 | A | 5/2009 |
| KR | 10-2010-0119505 | A | 11/2010 |
| KR | 10-1055033 | B1 | 8/2011 |

* cited by examiner

*Primary Examiner* — Y M. Lee

(74) *Attorney, Agent, or Firm* — Morgan, Lewis & Bockius LLP

(57) ABSTRACT

A head lamp apparatus may include a light source that emits a first light, a light guide disposed in front of the light source and having an entrance through which the first light from the light source is incident, and an exit through which the first light emitted from the light source is collected and radiated; and a condensing lens disposed in front of the light guide to concentrate the first light radiated from the light guide.

8 Claims, 3 Drawing Sheets

HEAD LAMP APPARATUS FOR VEHICLES

CROSS REFERENCE TO RELATED APPLICATION

The present application claims priority to Korean Patent Application No. 10-2013-0161139, filed on Dec. 23, 2013, the entire contents of which is incorporated herein for all purposes by this reference.

BACKGROUND OF THE INVENTION

1. Field of the Invention

The present invention relates, in general, to head lamps, and, more particularly, to a head lamp apparatus, which eliminates a reflector for realizing a high beam to improve heat dissipating performance, and prevents a sense of difference between low and high beams from occurring when the lamp is operated.

2. Description of Related Art

Generally, when a vehicle is driven in a relatively dark environment, for example, is driven at night, in a tunnel, through the fog, or in a rain, the vehicle is equipped with a head lamp to secure a clear view towards a front. The head lamp may optionally radiate a high beam for illuminating a long distance or a low beam for illuminating a short distance as necessary.

As shown in FIG. 1, a conventional head lamp is equipped with a low-beam LED 10 and a high-beam LED 20 separately. Thereby, the head lamp is also provided with a low-beam reflector 30 and a high-beam reflector 40.

In such a conventional head lamp, light radiated from each LED is reflected by the reflector and is moved to a front lens 60. As the Led emits light when the head lamp is driven, heat is generated in the reflector and the LED. In order to prevent a temperature from rising, a heat sink is utilized.

However, the conventional head lamp is problematic in that it is provided with the reflector for the low beam and the reflector for the high beam, respectively, so that large installation space is required in the head lamp, and the volume of the heat sink provided to dissipate heat from the plurality of reflectors is also increased.

Further, the head lamp is provided with a shield 50 to block some of light radiated from the LED. The shield 50 blocks or reflects light radiated from the LED depending on a pattern of the low beam or the high beam, thus securing a level of light suitable for an associated pattern.

However, the conventional head lamp is problematic in that a sense of difference is present between the low and high beams due to the shield, and a locally dark part occurs depending on the thickness of the shield, so that marketability is deteriorated.

The foregoing is intended merely to aid in the understanding of the background of the present invention, and is not intended to mean that the present invention falls within the purview of the related art that is already known to those skilled in the art.

The information disclosed in this Background of the Invention section is only for enhancement of understanding of the general background of the invention and should not be taken as an acknowledgement or any form of suggestion that this information forms the prior art already known to a person skilled in the art.

BRIEF SUMMARY

Various aspects of the present invention are directed to providing a head lamp apparatus, which eliminates a reflector for realizing a high beam to improve heat dissipating performance, and prevents a sense of difference between low and high beams from occurring using a shield, when the lamp is operated.

In an aspect of the present invention, a head lamp apparatus, may include a light source that emits a first light, a light guide disposed in front of the light source and having an entrance through which the first light from the light source is incident, and an exit through which the first light emitted from the light source is collected and radiated, and a condensing lens disposed in front of the light guide to concentrate the first light radiated from the light guide.

The head lamp apparatus may further include a lamp housing accommodating the light source, the light guide and the condensing lens therein.

The head lamp apparatus may further include a light emitting device disposed in the lamp housing and placed behind the light source, wherein the light emitting device radiates a second light upwards, and a reflector disposed in the lamp housing to reflect the second light, radiated from the light emitting device, towards the condensing lens.

An upper surface of the light guide is formed flat, so that the first light emitted from the light emitting device is reflected by the reflector and is reflected again on the upper surface of the light guide and thereby is radiated towards the condensing lens.

A central portion connecting the entrance and the exit of the light guide to each other is curved at both lateral side ends thereof from an inside to an outside.

The central portion of the light guide extends at both lateral side ends thereof from the entrance to the exit, and may include a first reflecting surface extending obliquely from the inside to the outside, and a second reflecting surface extending from the first reflecting surface to the exit in such a way as to be curved inwards and then extend to the exit.

The light guide is adjacent to the light source to allow the first light emitted from the light source to be incident on the entrance.

The exit of the light guide may include a first light emitting surface collecting and emitting the first light that is incident through the entrance, and a second light emitting surface provided under the first light emitting surface to emit irregular reflected first light.

The first light emitting surface is flat and aligned in a vertical direction to the longitudinal axis of the light guide.

The second light emitting surface disposed under the first light emitting surface is inclined rearwards from the first light emitting surface.

The condensing lens may include a convex lens.

As is apparent from the above description, the head lamp apparatus is advantageous in that the light emitted from the light source when the high beam is realized passes through the light guide and then is radiated, and the light guide guides incident light to the front and simultaneously collects the light on a condensing lens.

In this way, the high beam is realized, so that the conventional reflector for realizing the high beam is eliminated and thus heat dissipating performance is improved.

In addition, the light guide serves as the shield that reflects light radiated to realize the low beam, thus guaranteeing a suitable level of light when the low beam is radiated.

The methods and apparatuses of the present invention have other features and advantages which will be apparent from or are set forth in more detail in the accompanying drawings, which are incorporated herein, and the following Detailed Description, which together serve to explain certain principles of the present invention.

Figure 1:
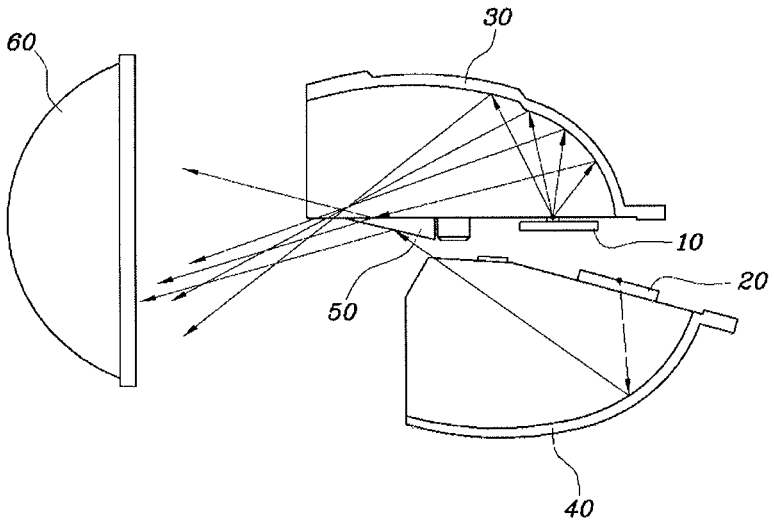
FIG. 1 (Related Art)
FIG. 1 is a view showing a conventional head lamp.

It should be understood that the appended drawings are not necessarily to scale, presenting a somewhat simplified representation of various features illustrative of the basic principles of the invention. The specific design features of the present invention as disclosed herein, including, for example, specific dimensions, orientations, locations, and shapes will be determined in part by the particular intended application and use environment.

In the figures, reference numbers refer to the same or equivalent parts of the present invention throughout the several figures of the drawing.

DETAILED DESCRIPTION

Reference will now be made in detail to various embodiments of the present invention(s), examples of which are illustrated in the accompanying drawings and described below. While the invention(s) will be described in conjunction with exemplary embodiments, it will be understood that the present description is not intended to limit the invention(s) to those exemplary embodiments. On the contrary, the invention(s) is/are intended to cover not only the exemplary embodiments, but also various alternatives, modifications, equivalents and other embodiments, which may be included within the spirit and scope of the invention as defined by the appended claims.

Hereinbelow, a head lamp apparatus according to the exemplary embodiment of the present invention will be described with reference to the accompanying drawings.

Figure 2:
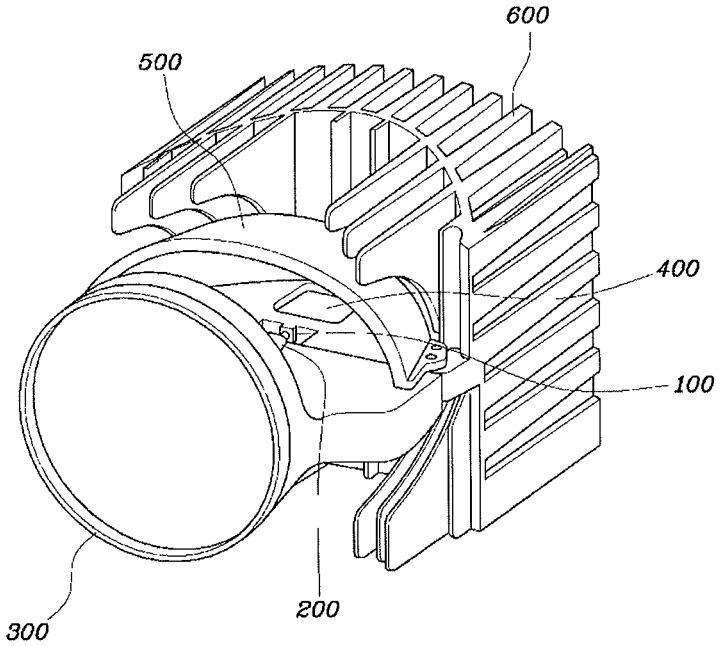
FIG. 2 is a perspective view showing a head lamp apparatus according to an exemplary embodiment of the present invention.
Figure 3:
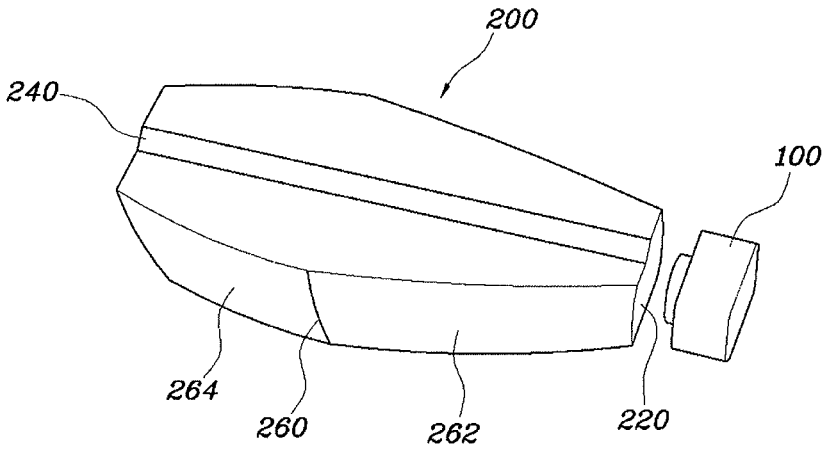
FIGS. 3 and 4 are views showing a light guide of the head lamp apparatus shown in FIG. 2.
Figure 4:
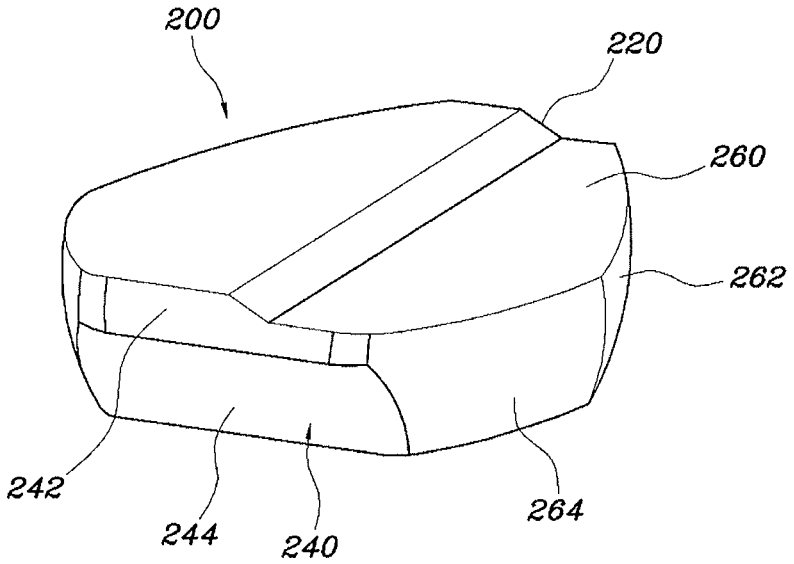

FIG. 2 is a perspective view showing a head lamp apparatus according to an exemplary embodiment of the present invention, and FIGS. 3 and 4 are views showing a light guide of the head lamp apparatus shown in FIG. 2.

The head lamp apparatus of this invention includes a light source 100 that emits light, a light guide 200 that is disposed in front of the light source 100 and includes an entrance 220 through which light from the light source 100 is incident, and an exit 240 through which the light emitted from the light source 100 is collected and radiated, and a condensing lens 300 that is disposed in front of the light guide 200 to collect the light radiated from the light guide 200.

The light source 100 is a light emitting device and may use a light emitting device (LED). The light guide 200 disposed in front of such a light source 100 is formed such that both side ends of an internal space thereof are curved at a predetermined angle, thus allowing light incident through the entrance 220 to move to the front and allowing light emitted through the exit 240 to be collected and radiated to the condensing lens 300.

Preferably, the condensing lens 300 disposed in front of the light guide 200 includes a convex lens.

The head lamp apparatus may further include a lamp housing that accommodates the light source 100, the light guide 200 and the condensing lens 300 therein.

The head lamp apparatus may further include a light emitting device 400 that is disposed in the lamp housing to be behind the light source 100 and radiates light upwards, and a reflector 500 that is disposed in the lamp housing to reflect light, radiated from the light emitting device 400, towards the condensing lens 300.

The light emitting device 400 may include an LED, and radiates light upwards. The reflector 500 is installed at an upper position of the lamp housing to reflect light radiated from the light emitting device 400. In this regard, the reflector 500 is formed in a predetermined curvature so that light emitted from the light emitting device 400 forms a focus on an end of the light guide 200, thus realizing the low beam through the condensing lens 300.

An upper surface of the light guide 200 is formed flat, so that the light emitted from the light emitting device 400 is reflected by the reflector 500 and is reflected again on the upper surface of the light guide 200 and thereby is radiated towards the condensing lens 300.

According to this invention, the light guide 200 is provided to realize the high beam, and besides, serves as a shield that blocks light to realize the low or high beam.

In other words, after light emitted from the light emitting device 400 is reflected by the reflector 500, the light forms a focus on the end of the light guide 200, thus realizing the low beam. Simultaneously, as totally reflected light is reflected on the upper surface of the light guide 200 and is radiated to the front, it is possible to secure a suitable level of light.

Now, the light guide 200 of this invention will be described in detail. A central portion 260 connecting the entrance 220 and the exit 240 of the light guide 200 to each other is curved at both side ends thereof from an inside to an outside.

That is, the central portion 260 of the light guide 200 extends at both side ends thereof from the entrance 220 to the exit 240, and includes a first reflecting surface 262 that extends obliquely from the inside to the outside, and a second reflecting surface 264 that extends from the first reflecting surface 262 to the exit 240 in such a way as to be curved inwards and then extend to the exit 240.

Figure 5:
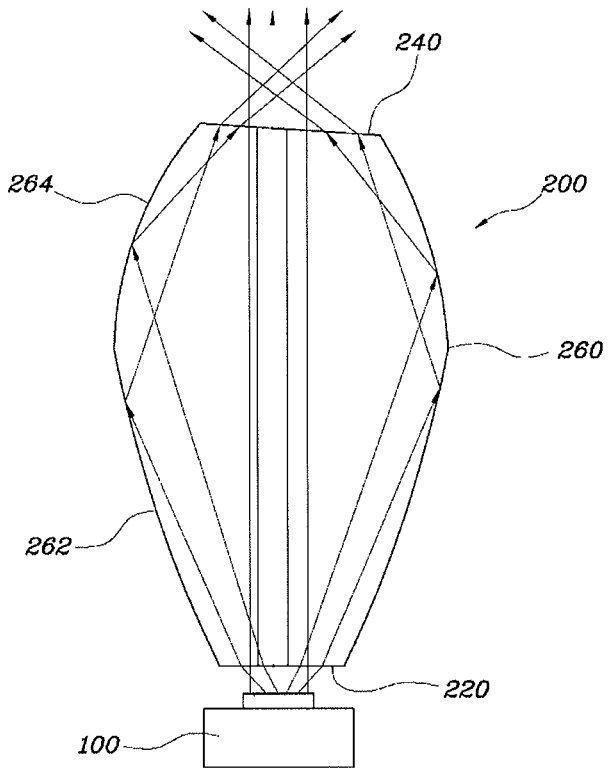
FIG. 5 is a view showing a path of light that passes through an interior of the light guide of the head lamp apparatus shown in FIG. 2.

In this way, as shown in FIG. 5, the light guide 200 is divided into the first reflecting surface 262 and the second reflecting surface 264. When the light emitted from the light source 100 is incident on the entrance 220 through the first reflecting surface 262 that is inclined outwards at a predetermined angle, the light is reflected to be moved to the exit 240. The light incident into the light guide 200 is reflected through the second reflecting surface 264 that extends in such a way as to be bent inwards, and then is collected on the condensing lens 300.

As such, when light emitted from the light source 100 is incident into the light guide 200 through the entrance 220, some of light spreading in all directions is reflected by the first reflecting surface 262 to be moved towards the exit 240. Further, light passing through the central portion 260 is reflected by the second reflecting surface 264 so that a focus is collected on the condensing lens 300. Consequently, it is possible to realize the high beam.

The light guide 200 may be adjacent to the light source 100 to allow the light emitted from the light source 100 to be incident on the entrance 220.

That is, the light guide 200 is preferably adjacent to the light source 100 so that all of the light emitted from the light source 100 is radiated through the light guide 200 without residual reflection. Hence, according to the design or appearance of the lamp housing, the light guide 200 may be integrated with the light source 100, thus allowing the light emitted from the light source 100 to be directly incident into the light guide 200.

Further, the exit 240 of the light guide 200 includes a first light emitting surface 242 collecting and emitting the light that is incident through the entrance 220, and a second light emitting surface 244 provided under the first light emitting surface 242 to emit irregular reflected light.

As shown in FIG. 4, the first light emitting surface 242 of the exit 240 is aligned with the entrance 220 in a row, and light incident through the entrance 220 is collected and radiated, thus realizing the high beam.

Further, the second light emitting surface 244 of the exit 240 is formed under the first light emitting surface 242, thus radiating irregularly reflected light among the light passing through the light guide 200 and thereby realizing the high beam and radiating some light at its lower position. As a result, it is possible to secure a clear view towards the front.

In an exemplary embodiment of the present invention, the first light emitting surface 242 is flat and aligned in a vertical direction to the longitudinal axis of the light guide 200.

The second light emitting surface 244 disposed under the first light emitting surface 242 is inclined rearwards from the first light emitting surface 242.

The lamp housing of this invention may be provided with a heat sink 600 to dissipate heat that is generated as light is emitted when the low or high beam is realized. According to an exemplary embodiment of the present invention, unlike the conventional head lamp apparatus, the reflector for realizing the high beam is eliminated, so that a heat dissipating structure is improved and heat dissipating performance is enhanced.

Figure 6:
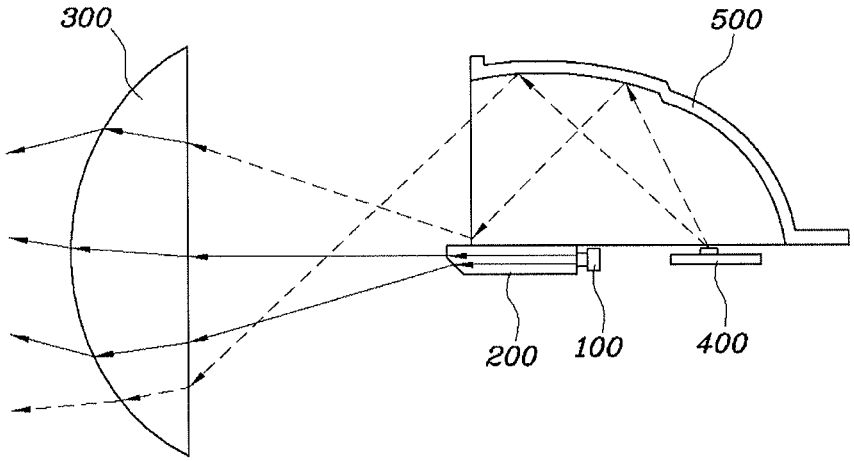
FIG. 6 is a view showing an operation of the head lamp apparatus shown in FIG. 2.

The operation of the head lamp apparatus according to the exemplary embodiment of the present invention, configured as described above, will be described below with reference to FIG. 6.

In order to realize the low beam, the head lamp apparatus of this invention includes the light emitting device 400 and the reflector 500 in the lamp housing. Light radiated upwards from the light emitting device 400 is reflected by the reflector 500, and the light reflected by the reflector 500 is moved towards the front, so that the light is radiated through the condensing lens 300 to the front of the vehicle.

Here, the light reflected through the reflector 500 forms a focus on the end of the light guide 200. Thereby, light radiated to the condensing lens 300 is realized in the low beam, and the light reflected to the upper surface of the light guide 200 is reflected and then radiated to the front, thus obtaining a sufficient quantity of light.

When realizing the high beam, the light emitted from the light source is incident through the entrance 220 of the light guide 200. Among the light moving in the light guide 200, light other than the light emitted directly towards the exit 240 is reflected on the first and second reflecting surfaces 262 and 264, collected on the exit 240 and then is emitted, so that the light is radiated on the condensing lens 300.

Here, in the light passing through the light guide 200, the light emitted through the first light emitting surface 242 of the exit 240 is finally realized in the high beam, and residual reflected light emitted through the second light emitting surface 244 illuminates a lower portion in front of the vehicle, thus securing a sufficient range of illumination for the front of the vehicle.

As described above, the present invention provides a head lamp apparatus, in which light emitted from a light source passes through a light guide and then is radiated, and the light guide guides incident light to a front and simultaneously collects the light on a condensing lens, thus realizing a high beam.

In this way, the high beam is realized using the light guide, so that a conventional reflector for realizing the high beam is eliminated and thus heat dissipating performance is improved.

In addition, the light guide serves as a shield that blocks or reflects light radiated to realize a low beam, thus guaranteeing a suitable level of light when the low beam is radiated.

For convenience in explanation and accurate definition in the appended claims, the terms "upper", "lower", "inner" and "outer" are used to describe features of the exemplary embodiments with reference to the positions of such features as displayed in the figures.

The foregoing descriptions of specific exemplary embodiments of the present invention have been presented for purposes of illustration and description. They are not intended to be exhaustive or to limit the invention to the precise forms disclosed, and obviously many modifications and variations are possible in light of the above teachings. The exemplary embodiments were chosen and described in order to explain certain principles of the invention and their practical application, to thereby enable others skilled in the art to make and utilize various exemplary embodiments of the present invention, as well as various alternatives and modifications thereof. It is intended that the scope of the invention be defined by the Claims appended hereto and their equivalents.

What is claimed is:

1. A head lamp apparatus, comprising:

a light source that emits a first light;

a light guide disposed in front of the light source, and including:

an entrance through which the first light emitted from the light source is incident; and an exit through which the first light emitted from the light source is collected and radiated; and a condensing lens disposed in front of the light guide to concentrate the first light radiated from the light guide, wherein the exit of the light guide comprises:

a first light emitting surface collecting and emitting the first light that is incident through the entrance; and a second light emitting surface provided under the first light emitting surface to emit irregular reflected first light, wherein the first light emitting surface is flat and aligned in a vertical direction to a longitudinal axis of the light guide, and wherein the second light emitting surface disposed under the first light emitting surface is inclined rearwards from the first light emitting surface.

2. The head lamp apparatus as set forth in claim 1, further comprising a lamp housing accommodating the light source, the light guide and the condensing lens therein.

3. The head lamp apparatus as set forth in claim 2, further comprising:

a light emitting device disposed in the lamp housing and placed behind the light source, wherein the light emitting device radiates a second light upwards; and a reflector disposed in the lamp housing to reflect the second light, radiated from the light emitting device, towards the condensing lens.

4. The head lamp apparatus as set forth in claim 3, wherein an upper surface of the light guide is formed flat, so that the second light emitted from the light emitting device is reflected by the reflector and is reflected again on the upper surface of the light guide and thereby is radiated towards the condensing lens.

5. The head lamp apparatus as set forth in claim 1, wherein a central portion connecting the entrance and the exit of the light guide to each other is curved such that a width of the central portion is wider than at least one of a width of the entrance and a width of the exit.

6. The head lamp apparatus as set forth in claim 5, wherein the central portion of the light guide extends at both lateral side ends thereof from the entrance to the exit, and comprises:

a first reflecting surface extending obliquely outwards from the entrance; and a second reflecting surface extending from the first reflecting surface to the exit in such a way as to be curved inwards and then extend to the exit.

7. The head lamp apparatus as set forth in claim 1, wherein the light guide is adjacent to the light source to allow the first light emitted from the light source to be incident on the entrance.

8. The head lamp apparatus as set forth in claim 1, wherein the condensing lens comprises a convex lens.

* * * * *